US009732614B2

(12) United States Patent
Davison

(10) Patent No.: US 9,732,614 B2
(45) Date of Patent: Aug. 15, 2017

(54) DEVICE, METHOD AND SYSTEM FOR LOADING FIXATIVES FOR ROCK BOLTS

(71) Applicant: GAZMICK PTY LTD, Williamstown (AU)

(72) Inventor: Gary Davison, Williamstown (AU)

(73) Assignee: GAZMICK PTY LTD, Williamstown (AU)

( * ) Notice: Subject to any disclaimer, the term of this patent is extended or adjusted under 35 U.S.C. 154(b) by 0 days.

(21) Appl. No.: 14/439,732

(22) PCT Filed: Nov. 8, 2013

(86) PCT No.: PCT/AU2013/001287

§ 371 (c)(1),
(2) Date: Apr. 30, 2015

(87) PCT Pub. No.: WO2014/071452

PCT Pub. Date: May 15, 2014

(65) Prior Publication Data

US 2015/0300171 A1 Oct. 22, 2015

(30) Foreign Application Priority Data

Nov. 9, 2012 (AU) ..... 2012904894

(51) Int. Cl.

| | |
|---|---|
| ***E21D 20/02*** | (2006.01) |
| ***E21D 20/00*** | (2006.01) |
| ***E21D 21/00*** | (2006.01) |

(52) U.S. Cl.

CPC ..... *E21D 20/023* (2013.01); *E21D 20/025* (2013.01); *E21D 20/026* (2013.01);
(Continued)

(58) Field of Classification Search

CPC ..... E21D 20/00; E21D 20/02; E21D 20/021; E21D 20/023; E21D 20/025;
(Continued)

(56) References Cited

U.S. PATENT DOCUMENTS 3,702,060 A * 11/1972 Cumming ..... E21D 20/025 405/259.2
4,096,944 A * 6/1978 Simpson ..... C04B 40/0666 106/784

(Continued)

FOREIGN PATENT DOCUMENTS

| | | | |
|---|---|---|---|
| AU | 2011254017 | A1 | 7/2012 |
| WO | 03/014517 | A1 | 2/2003 |
| WO | 03/044324 | A1 | 5/2003 |

OTHER PUBLICATIONS

Supplementary European Search Report, Application No. EP13853829.

*Primary Examiner* — Frederick L Lagman
*Assistant Examiner* — Stacy Warren
(74) *Attorney, Agent, or Firm* — Dennemeyer & Associates, LLC

(57) ABSTRACT

The present invention relates to a device, method and system for the installation of a fixative in a drill-hole, such as to secure rock bolts. The device comprises (a) a chamber adapted to hold the fixative, and (b) a thrust member, wherein the fixative is displaced from the chamber into the drill-hole following application of force to the thrust member.

12 Claims, 6 Drawing Sheets

(52) U.S. Cl.
CPC ..... *E21D 21/006* (2016.01); *E21D 21/0033* (2013.01); *E21D 21/0093* (2013.01)

(58) Field of Classification Search
CPC . E21D 20/026; E21D 20/028; E21D 21/0033; F16B 13/141–13/145
USPC ..... 405/259.1, 259.5, 259.6
See application file for complete search history.

(56) References Cited

U.S. PATENT DOCUMENTS

| | | | | | |
|---|---|---|---|---|---|
| 4,343,399 | A * | 8/1982 | Patel | F16B 13/143 | 206/222 |
| 4,516,883 | A | 5/1985 | Zeitler | | |
| 4,518,292 | A * | 5/1985 | Calandra, Jr. | E21D 20/02 | 29/522.1 |
| 4,601,614 | A | 7/1986 | Lane et al. | | |
| 4,830,558 | A * | 5/1989 | Sweeney | F16B 47/003 | 248/205.3 |
| 4,861,197 | A * | 8/1989 | Calandra, Jr. | E21D 21/008 | 405/259.3 |
| 4,976,571 | A * | 12/1990 | Mraz | E21D 20/026 | 405/259.1 |
| 5,544,980 | A * | 8/1996 | Seegmiller | E21D 21/0026 | 405/259.1 |
| 6,033,153 | A * | 3/2000 | Fergusson | E21D 20/02 | 405/259.1 |
| 2004/0161316 | A1 | 8/2004 | Locotos et al. | | |
| 2011/0268526 | A1* | 11/2011 | Wu | E21D 21/008 | 411/1 |

* cited by examiner

DEVICE, METHOD AND SYSTEM FOR LOADING FIXATIVES FOR ROCK BOLTS

FIELD OF INVENTION

The present invention relates generally to the loading of rock bolts used for stabilisation of earthen formations, such as the roof or side walls of an underground mine, a tunnel or above ground, rock cut.

In one form the invention relates to the loading of fixatives such as chemical anchors and cementitious grouts into drill holes.

In another form the invention relates to the securing of rock bolts in drill holes.

In particular, the present invention relates to a device that reduces known difficulties associated with loading fixatives. Further, the present invention provides a method that reduces known difficulties associated with inserting fixative material into drill holes to secure rock bolts.

It will be convenient to describe the present invention in relation to man-made underground structures such as tunnels, however it should be appreciated that the present invention is not so limited and can be used in the stabilisation of both above ground and underground earthen structures, whether man-made or naturally occurring and fixing fasteners into man made structures such as concrete Furthermore, while it will also be convenient to describe the present invention with reference to the mining industry, it should be appreciated that the present invention is not limited to mining applications and can be used by other industries such as civil engineering and geotechnical engineering.

BACKGROUND ART

The discussion throughout this specification comes about due to the realisation of the inventor and/or the identification of certain related art problems by the inventor and, moreover, any, discussion of documents, devices, acts or knowledge in this specification is included to explain the, context of the invention. It should not be taken as an admission that any of the material forms a part of the prior art base or the common general knowledge in the relevant art in Australia or elsewhere on or before the priority date of the disclosure and claims herein.

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Rock bolts have been used for many years to support earthen formations for mining and civil engineering.

Where used herein the term 'rock bolt' is intended to refer to any elongate anchor for location in drill holes to stabilise rock excavations and may alternately be known by names such as 'rock stabiliser', 'roof-bolt', 'friction stabiliser' or 'split-set' bolt. Rock bolts transfer load from the unstable exterior of an earthen formation, to the confined and much stronger interior of the rock mass.

Traditional rock bolts generally consist of steel rods with a mechanical or chemical anchor at one end or chemical anchor along their whole length and a face plate and nut at the other end. They are typically tensioned after installation by tightening the nut.

Another invention, well known 'split set' rock bolts have an elongate tube that are generally of circular or C-shaped cross-section and having a longitudinal channel or groove along the entire length of the tube. Split set rock bolts are usually installed into a hole drilled into an earthen formation using an impact tool.

With Split Sets the diameter of the drill hole is slightly less than the outer diameter of the elongate tube, so that during installation, the elongate tube is subject to radial compressive force. The compressive force causes the channel or groove to at least partly close, reducing the diameter of the tube to fit the diameter of the hole. This ensures that there is at least some frictional engagement between the elongate tube and the earthen formation.

For permanent applications, high load areas, or in rock in which corrosive groundwater is present, the space between the bolt and the surrounding earth can be filled with an aqueous slurry of cementitious grout. This keeps the rock bolt in place and reduces the likelihood of rock bolt failure due to rusting or corrosion. After grouting the bolt installations shear strength is also increased, but grout shrinkage can reduce the stiffness of the rock bolt. The grout is typically a coarse cement composition that can flow along the drill hole and into narrow cavities to fill them. The grout subsequently sets to form a solid that consolidates with the adjoining earth to form a consolidated mass.

The traditional method of grouting rock bolts is to use a short feed tube through which the grout is pumped into the drill hole, plus a smaller diameter breather tube extending to the end of the hole, to bleed the air from the hole. However, there are problems associated with the grouting of rock bolts. It can be difficult to pump grout into a drill hole in a matter that causes it to flow along the entire length of the rock bolt tube. Often air is trapped inside the drill hole and cannot be vented to make way for the flow of grout. Also, rock bolts are often inserted into the vertical drill holes in mine roofs. If grout of low viscosity or slow setting time is used it can tend to fall out of the drill hole under the action of gravity. Full mechanical coupling does not occur until the grout has set therefore, in the case of tunnels, the workspace is not supported and work cannot be performed under unsupported ground. This slows up the tunnelling work at an enormous expense.

Mechanically anchored rock bolts can work loose from the drill hole, particularly in weak, closely jointed or soft rock. In these situations chemical anchors are often used. Chemical anchors typically consist of a cartridge sheath containing two separate compartments, one holding a resin and the other holding a catalyst. The cartridges are pushed to the end of the drill hole ahead of the rock bolt, which is then spun into the cartridges. The compartments are thus broken open and the resin and catalyst are mixed together by the spinning action. Setting of the resin commences within a few seconds of being mixed with the catalyst and subsequently cures to produce a very strong and immediate anchor.

Resin cartridges are high cost and difficult to manufacture transport and store. The resin and the catalyst deteriorate at room temperature or higher so in hot environments there is a need for the product to be refrigerated and must undergo careful rotational stock control. The less expensive cementitious grout tends to be used for large volume applications, but compared with resin, grout is extremely slow to cure.

However there are several difficulties associated with use of resin cartridges, particularly practical problems associated with inserting the resin cartridges into "distant" holes and breaking the plastic sheath of the cartridges and mixing the resin and catalyst together effectively. In some instances the bolt will not break the packaging holding the catalyst but lay alongside it in the hole or the plastic holding the hardener will wrap around the bolt 'isolating' the bolts from the mixed resin and thereby not bonding the bolt to the rock. Without the catalyst packaging being broken the resin mastic will not harden and the bolt will be ineffective. This is known as "gloving".

Drill holes are typically drilled into unsupported earth in mines and tunnels hence the need for the rock bolt to provide support. The unsupported earth around the rock hole in a mine or tunnel roof is associated with a risk of collapse or rockfall, therefore it is critical that workman do not work beneath an unsupported area. They are typically required to remain 5 to 6 meters from the area. However, it is difficult for the workmen to install resin in drill holes that are 5 to 6 meters removed from them. Preferably, sausage-shaped cartridges full of resin are pneumatically blown into drill holes but the process requires precise alignment of devices that are easily damaged in the underground environment. As an alternative, it is often necessary for the resin to be installed using pushing devices which are cumbersome and prone to damage. Furthermore, the resin cartridges are heavy and often fall from the drill holes. Workmen may take risks by approaching the unsupported earth to recover the fallen cartridges and by attempting to reinstall them in the drill holes. For very long holes the volume of resin that is required is quite large and the cartridges can be difficult to install into the drill holes.

Resin sausages can only be, in practical terms, in binary terms. Sometimes because variations in the drilled hole length and diameter exists, fractions of sausages re required to be installed. This is not practical resulting in poor, i.e. non complete, encapsulation of rock bolts at the very least exposing the rock bolt to corrosion.

It is also important, if not difficult, to maintain axial alignment during rotation. Furthermore the length of time and the number of rotations for spinning the rock bolt in the resin is limited. Once the setting process has been initiated, the structure of the resin can be damaged and the overall installation weakened by additional spinning. An over mixed chemical anchor is worse than an under mixed chemical anchor because the early gel formed is 'ground up' by the spinning.

In some rock structures, the walls of the drill hole become clay coated or wet during drilling. This tends to allow the resin cartridges to slip during rotation, resulting in incomplete mixing and unsatisfactory bonding, particularly in longer cartridges. Pockets of unmixed resin and catalyst and plastic cartridge sheath may be left attached to the drill hole wall.

In highly fractured rock structures, the resin may quickly seep into the surrounding rock so that it never comes in contact with the catalyst. This leaves voids in the resin column surrounding the rock bolt with concomitant reduction in the effectiveness of the chemical anchor as compared with fully chemically encapsulated rock bolts.

Even if the diameter of the drill hole is correct, if the hole is drilled too deeply as compared to the length of the rock bolt (ie the bolt is not 'bottomed' in the drill hole), the resin and catalyst cannot be mixed at the end of the hole and is completely wasted.

Furthermore, packaged resin "sausages' are difficult and relatively expensive to manufacture.

Accordingly there is a need for better and more efficient loading of drill holes with fixatives such as grout and resin.

SUMMARY OF INVENTION

An object of the present invention is to improve the efficiency with which a rock bolt may be located and secured in a drill hole.

A further object of the present invention is to improve the anchoring of a rock bolt in a drill hole.

A further object of the present invention is to improve the efficiency of loading a drill hole with a fixative.

A further object of the present invention is to alleviate at least one disadvantage associated with the related art.

It is an object of the embodiments described herein to overcome or alleviate at least one of the above noted drawbacks of related art systems or to at least provide a useful alternative to related art systems.

In a first aspect, the present invention provides a device adapted for use in the installation of a fixative in a drill hole, the device comprising;

a. a chamber adapted to hold the fixative, and b. a thrust member, wherein the fixative is displaced from the chamber into the drill hole following application of force to the thrust member.

Typically the spout is circular, or polygonal in cross section. The maximum cross sectional diameter is slightly less than the cross sectional diameter of any drill hole into which it is inserted. In a particularly preferred embodiment the chamber comprises a cylinder that is open at one end. In another embodiment, the device includes two or more sub-chambers.

The chamber is preferably much larger than the diameter of the bore with a length, and therefore a volume to suit the volume of material to be injected into the hole.

The thrust member is typically a plate having a shape that corresponds to the cross sectional shape of the chamber. The thrust member may include one or more frangible sections. The thrust member may move at least partially longitudinally along. the interior of the chamber upon the application of force.

Alternatively or in addition the body of the thrust member may include one or more frangible sections. Upon application of force, such as by a push rod, the push rod can penetrate the thrust member and pass through part, or all of the length of the chamber. The push rod may be, for example, a rock bolt that can penetrate the thrust member and pass through into the drill hole.

Typically a fixative will comprise two or more components that are separated until it is desired to, initiate setting or curing. The two or more components may be separated into the two or more sub-chambers in the chamber. However it is also possible that the fixative comprises a single one chamber component.

For example, a chemical anchor will typically comprise at least a resin and a catalyst. The resin and catalyst are separated within the chamber (so that they do not commence reacting) by any convenient means. For example the resin and catalyst may be contained in separate capsule(s) of any convenient shape. This would include elongate cartridges or spherical capsules. Alternatively, the chamber may be modified to include one or more interior walls that divide the chamber into separate sub-chambers or repositories for resin and catalyst. Typically the capsule(s), or the walls, crush or otherwise disintegrate upon the application of force by the thrust member, liberating the resin and catalyst so that they are no longer separated. In yet another alternative, the device may be adapted to have a single chamber adapted to deliver a fixative preferably by the action of installation of a rock bolt.

In a second aspect, the present invention provides a device for loading a fixative into a drill hole, the device comprising:

a. a chamber having a front wall and peripheral wall, the chamber adapted to hold the fixative,
b. an exit port associated with the front wall,
c. a thrust member adapted to be disposed in the chamber, at least part of which can be forced towards the exit port by a push rod,
d. an inlet port associated with the thrust member and adapted to engage an end of the push rod, wherein upon application of force by the push rod, at least part of the thrust member is pushed through the chamber, purging the fixative towards the exit port.

Typically the push rod is a rock bolt. The word 'rock bolt' is intended herein to mean any form of earth stabiliser, rock stabiliser which serves to facilitate stability of naturally occurring or man-made earthen formations or which locates a fastener into concrete or rock like material The earthen formations may include, for example, mining tunnels, open cut mining sites, transport tunnels forming part of a road or rail system, cuttings or cliffs When the fixative is a chemical fixative, typically the chamber is adapted to hold resin and catalyst. When the fixative is a cementitious grout, typically the chamber is adapted to hold cement and water.

When cementitious grout is used in the chamber, it may be activated by, for example, immersing it in water. In this case the push rod may be, for example, a "split set" rock bolt and the chamber is attached to the 'split set'. The chamber is then passed into a drill hole and pushing force applied to the split set pushed injecting the grout from the chamber into the drill hole, and additionally forcing the activated grout into the centre of the split set. Once it has set the grout imparts rigidity to the 'split set' significantly increasing its frictional engagement with the drill hole wall.

The end of the rock bolt can be engaged with the inlet port of the device prior to installing the rock bolt into a drill hole and both inserted into the drill hole in a single action otherwise known as a 'single pass'. In a preferred embodiment the inlet port comprises a sleeve that fits over the leading end of the rock, bolt.

The rock bolt is pushed along into the drill hole, preceded by the device until the chamber abuts the end of the drill hole and can move no further. Further force applied to the rock bolt pushes the thrust member along the immobilised chamber, purging fixative (such as, in the form of its resin and catalyst components) through the exit port and into the gap between the rock bolt and the drill hole wall.

With continued application of force, at least part of the thrust member may move all the way through the chamber until it abuts the front wall. In a particularly preferred embodiment, when the thrust plate, or part thereof, contacts the front wall, the end of the rock bolt ruptures at least part of the thrust plate and passes through the exit port. The rock bolt can then be rotated to mix the components of the chemical anchor. The rock bolt washer then compresses the remainder of the chamber thus doing away with need for the chamber to be removed from the hole for disposal.

In a particularly preferred embodiment the thrust plate includes a rupture disk which can rupture to allow the end of the rock bolt to pass through the exit port. The shape of the rupture disk may for example, match the cross sectional shape of the exit port. The thrust plate may alternatively or in addition include vent holes for exit of air as the thrust plate is pushed through the chamber.

In another preferred embodiment the front wall of the chamber includes one or more frangible sections so that the end of the rock bolt can break through the front wall as an alternative, or in addition to passing through the exit port.

In another preferred embodiment the wall of the chamber includes frangible sections or is collapsible so that substantially all the fixative is liberated from the chamber as the rock bolt passes through the chamber.

In a further third embodiment the present invention provides a method of installing a rock bolt and fixative, the method including the steps of:

a. drilling a hole in a region to be stabilised,
b. inserting a device according to the present invention containing fixative into a drill hole,
c. inserting a rock bolt into the drill hole, and
d. applying force to the rock bolt such that at least some of the fixative is displaced from the device.

In a further embodiment the present invention provides a method of installing a rock bolt and fixative, the method including the steps of;

a. drilling a hole in the region to be stabilised,
b. attaching a device according to the present invention containing fixative to an end of a rock bolt,
c. applying force to the rock bolt to push the device along the drill hole,
d. displacing substantially all of the fixative from the device, and
e. applying further force such that the end of the rock bolt passes through the device and into the drill hole.

In a further aspect, the present invention provides a system for stabilising an earthen formation, the system comprising:

a. a rock bolt for insertion in a drill hole in a formation to be stabilised,
b. a fixative, and
c. a device according to the present invention.

In a further aspect, the present invention provides a system for stabilising an earthen formation using the device of the present invention, the system comprising the following steps:

a. filling the chamber with an activated cementitious grout;
b. attaching the chamber to a split set rock bolt;
c. locating the chamber in a drill hole with the exit end leading;
d. applying force to the split set, such that the activated grout is injected into the drill hole and forced into the split set.

Other aspects and preferred aspects are disclosed in the specification and/or defined in the appended claims, forming a part of the description of the invention.

In essence, embodiments of the present invention stem from the realisation that a fixative can be loaded into a drill hole and the components mixed in conjunction with a rock bolt in a single pass.

Advantages provided by the present invention comprise the following:

improved mixing of the components of a fixative,
improved structure of the cured fixative including improved encapsulation of the rock bolt, reduced void formation in the fixative, concomitantly improving load transfer and increasing the load capacity of the rock bolt;

a fixative and rock bolt can be introduced to drill holes simultaneously, in a single action, saving loading time, absence of gloving, easier manufacture of fixative, easier installation of fixative into drill holes, ability to vary or tailor the amount of fixative placed into boreholes, ability to combine fixative hardener with rock bolts, and ability to install rock bolts remotely from human operators because fixative does not need to be pumped in manually.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION

Figure 1:
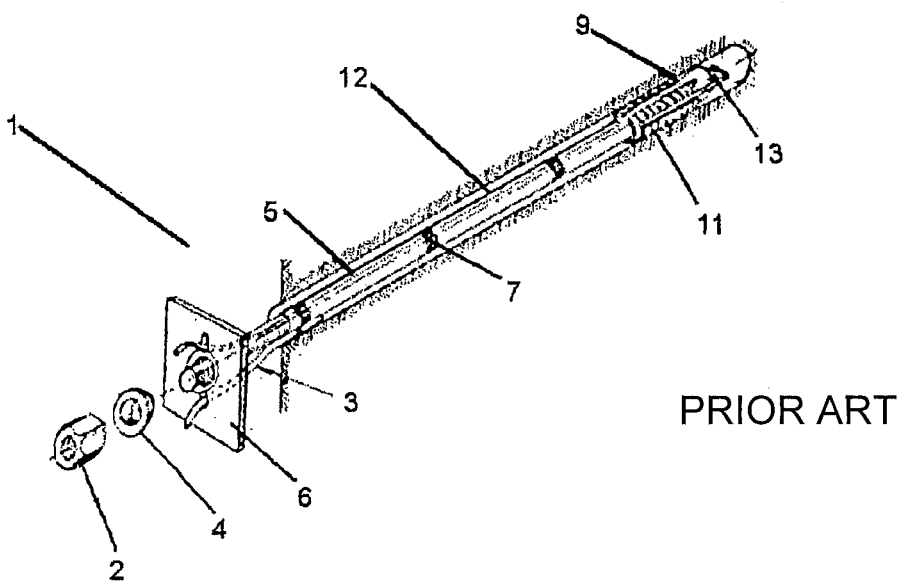
FIG. 1 is a drawing depicting the components of a typical grouted rock bolt.

FIG. 1 is a drawing depicting the components and set up for a typical grouted rock bolt (1) of the prior art. A variety of types of rock bolts are commercially available but the basic principle of operation is the same in all. As shown in FIG. 1 the typical components are a tapered cone (9) with an internal thread and a pair of wedges held in place by a bail (13). The cone (9) is screwed onto the threaded end of the elongated body (12) of the rock bolt and the entire assembly is inserted in to a drill hole. The length of the drill hole is usually at least 100 mm longer than the bolt otherwise the bail (13) will be dislodged by being forced against the end of the drill hole. Once the assembly is in place a sharp pull on the end of the bolt will seat the rock bolt. Tightening the bolt forces the cone further into the wedge, thereby increasing the anchoring force.

These rock bolts work well in hard rock but are not very effective in closely jointed rock and soft rock because rock in contact with the wedge grips tends to fail. Grout or resin cartridges are often inserted to alleviate this problem.

At the end of the rock bolt projecting from the drill hale there is a fixed head or threaded end and nut (2). A faceplate (1) distributes the load form the bolt onto the rock face. In addition a tapered washer or conical seat (4) compensates for the fact that the rock face is typically at right angles to the bolt. Tensioning of rock bolts is important to ensure that all the components are in contact and that a positive force is applied to the rock.

Traditionally, grouting is carried out by using a short grout tube (5) to feed the grout into the drill hole. A smaller diameter breather tube (3) to bleed air is taped (7) to the rock bolt and extends to the end of the hole.

Figure 2:
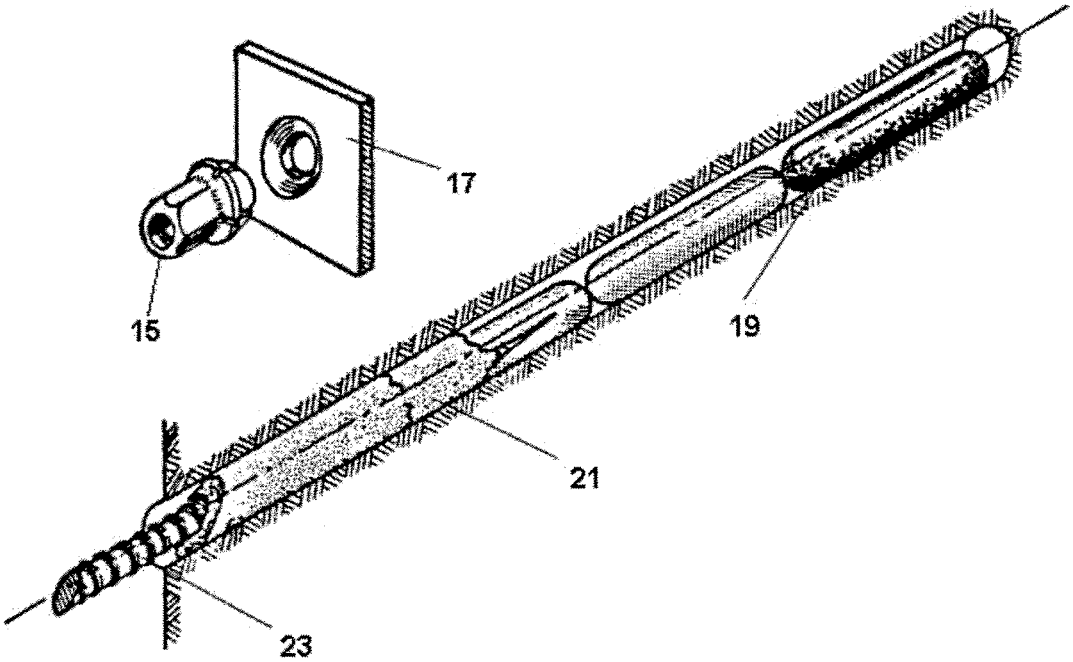
FIG. 2 is a drawing depicting a typical set-up for a resin anchored and grouted rock bolt.

FIG. 2 illustrates in cross-section a typical set-up of the prior art for creating a resin anchored and grouted rock bolt. Slow setting grout cartridges (21) are located behind fast setting anchor cartridges (19) in a drill hole. The rod of the rock bolt (23) is then spun through the cartridges (19) to mix the resin and catalyst, thus initiating the chemical reaction. The rock bolt (23) is tensioned using a faceplate (17) and nut (15) applied to the end of the rock bolt (23) after the fast setting anchor resin has set. The cartridges of slow setting grout (21) subsequently set and lock the rod in place. The slow setting grout is timed to set in about 30 minutes, so the rock bolt (23) can be tensioned within two or three minutes of installation after the fast anchor resin has set. This tension is then locked in by the later setting grout cartridges and the resulting installation is a fully tensioned, fully installed rock bolt.

Figure 3:
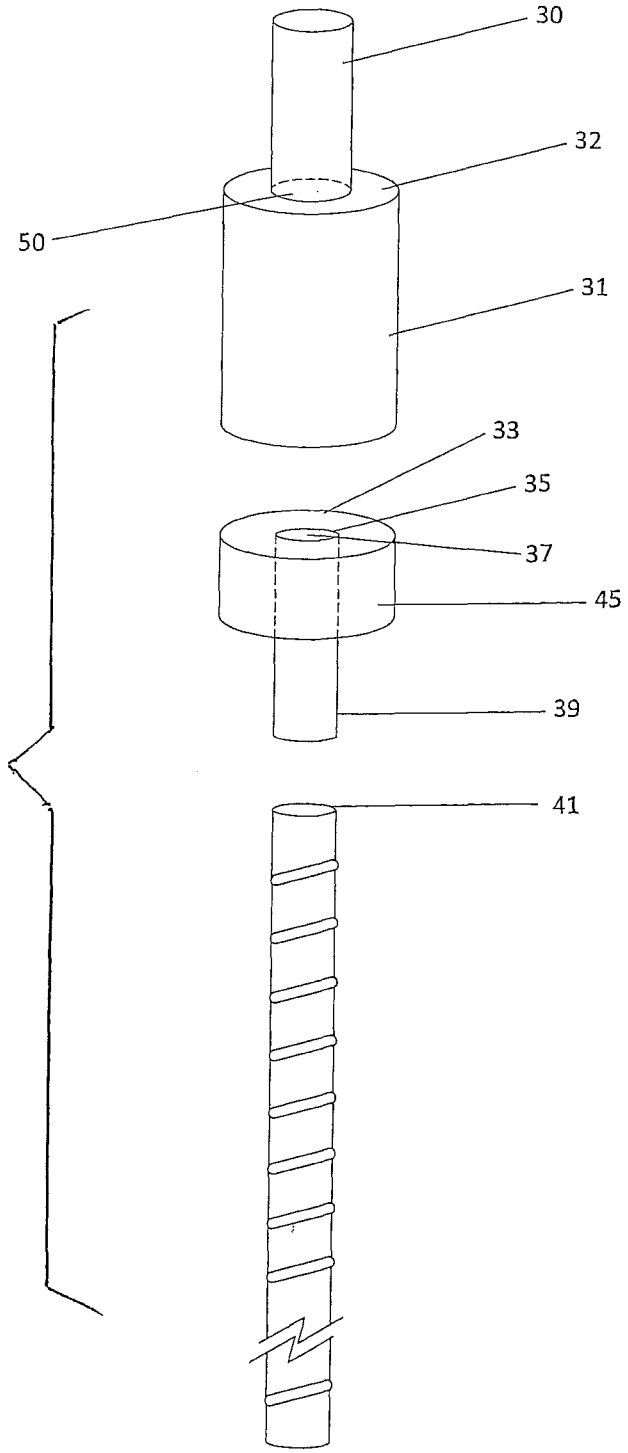
FIG. 3 is a drawing depicting one embodiment of a device according to the present invention.

FIG. 3 depicts a device according to the present invention for loading a chemical anchor in a drill hole. In this embodiment, the device includes a generally cylindrical chamber (31) adapted to hold the chemical anchor. One end of the chamber (31) is open, and adapted to receive a thrust member (33) comprising a flat disk, with a skirt (45) associated with a cylindrical inlet port (39). The skirt assists in aligning the thrust member (33) in the chamber and helps to avoid misalignment. It will be appreciated that other means for aligning the thrust member (33) such as a keyway type arrangement could also be used. The other end of the chamber comprises a front wall (32) and an exit port (50) leading to a cylindrical exit spout (30) associated with the front wall (32).

Figure 4:
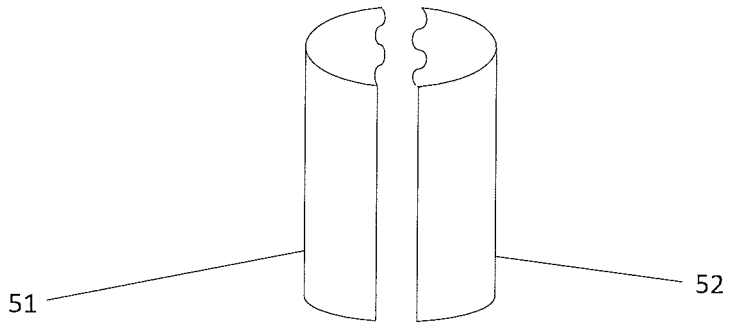
FIG. 4 is a drawing depicting one embodiment of fixative used to anchor a rock bolt.
Figure 5:
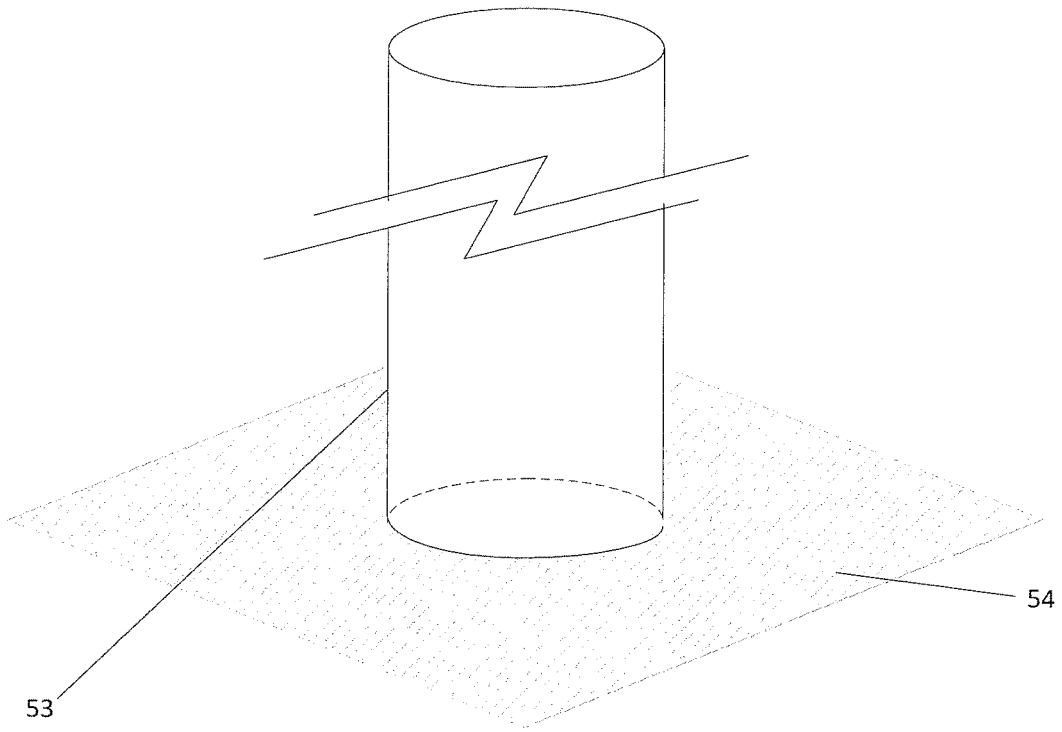
FIG. 5 is a drawing depicting a drill hole for receiving fixative and a rock bolt, in a region to be stabilized.
Figure 6:
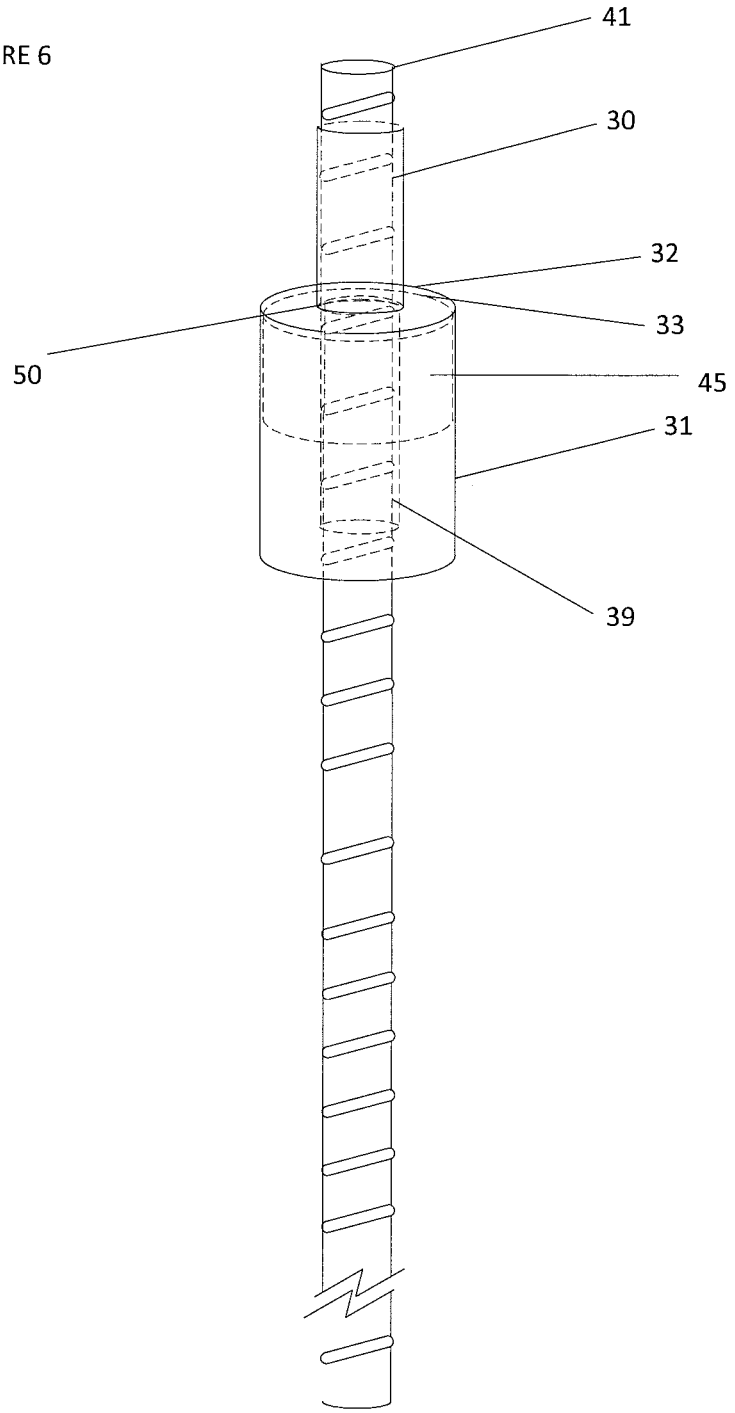
FIG. 6 is a drawing depicting a rock bolt installation according to one aspect of the invention.

FIG. 4 depicts fixative used to anchor a rock bolt according to one aspect of the invention. The fixative comprises resin (51) and catalyst (52). FIG. 5 depicts a drill hole (53) for receiving fixative and a rock bolt, in a region to be stabilized (54). FIG. 6 depicts a rock bolt installation according to one aspect of the invention.

In use, the chamber (31) is filled with or contains a sufficient dose of the component(s) of the fixative. In this illustration, the fixative is a chemical anchor comprising resin (51) and catalyst (52), but as one alternative the fixative could be a grout comprising cement and water. The thrust member (33) is then inserted to close the chamber (31). The end of a rock bolt (41) is then inserted into the inlet port (39) which fits over the end of the rock bolt like a sleeve. The device, supported on the end of the rock bolt (41), is then inserted in a drill hole. The rock bolt (41) is pushed along into the drill hole, preceded by the device until the chamber (31) abuts the end of the drill hole and can move no further. Further force applied to the rock bolt (41) pushes the thrust member (33) along the immobilised chamber (31), urging the chemical anchor out the exit port (50), through the exit spout (30) and into the gap between the rock bolt (41) and the drill hole wall.

With continued application of force, the thrust member (33) is pushed all the way through the chamber (31) until it abuts the front wall (32). In this embodiment, the thrust member (33) includes a circular rupture disk frangible section (37) defined by a series of perforations, splits or pre weakened components (35). When the thrust plate contacts the front wall (32), the end of the rock bolt ruptures (41) the perforations and both the rupture disk and the end of the rock bolt (41) pass through the exit port (50). The rock bolt can then be rotated to mix the components of the chemical anchor.

When the thrust plate contacts the front wall (32), the end of the rock bolt ruptures (41) the perforations and both the rupture disk and the end of the rock bolt (41) pass through the exit port (30). The rock bolt can then be rotated to mix the components of the chemical anchor.

In one embodiment, the present invention may be rendered in a form in which the "spout" 30 may be used to locate the device in the drill hole, the drill hole typically varies from 33 mm to 45 mm but can be as large as approx 64 mm. The chamber 31, typically 100 mm to 125 mm in diameter and 100 to 125 mm in length (note these dimensions will depend on the annular volume of the rock hole and the bolt length and may further vary on the dose of fixative to be delivered) and is adapted to hold the fixative. The chamber 31 also may be modified to be conical or hemispherical or otherwise shaped toward the spout end 32, and may be designed so that the device of the present invention may appropriately meet and/or match any inconsistencies in the surface variation of the rock proximate the hole in the rock. In use, the fixative is displaced from the chamber 31 into the drill hole following application of force to the thrust member 33. The thrust member 33 may match the shape of the chamber. The thrust member 33 is appropriately weakened to be frangible 35, 37 so that the rock bolt 41, upon application of a sufficient force, moves the thrust member 33 to cause the fixative to extrude out of the chamber 31 and into the hole via the spout 30, and after the fixative has been extruded into the rock hole, and the thrust member 31 comes to a position where it is no longer able to move in the chamber, the force can enable fracture of the frangible section(s) 35 and/or 37 and enable the bolt 41 to penetrate through the thrust member 33, pass through the spout 30 and enter the rock hole. Upon entering the rock hole, the rock bolt can be spun to mix the resin and allow the resin to secure the rock bolt in the hole in the rock. While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The invention claimed is:

1. A device for loading a fixative into a drill hole in a region to be stabilized, the device comprising:

a. a chamber adapted to hold a fixative, and b. a thrust member, wherein the fixative is configured to be displaced at least partially from the chamber positioned external of a drill hole, into the drill hole, following application by a rod member of a first predetermined force to the thrust member to move the thrust member through the chamber, wherein the thrust member comprises at least one frangible section and the rod member in use applies a second predetermined force to the thrust member to rupture the at least one frangible section, and wherein the chamber has a fixed internal transverse dimension greater than that of the drill hole whereby, in use, the chamber is maintained entirely external of the drill hole.

2. A device according to claim 1 wherein the chamber comprises a front wall and peripheral wall with an exit port for said fixative formed in said front wall, said thrust member comprising an externally facing guide tube to engage, in use, with an end zone of said rod member.

3. A device according to claim 2 wherein said thrust member is independent of said peripheral wall of said chamber and, in use, moves through said chamber towards said exit port to displace the fixative at least partially from said chamber.

4. A device according to claim 1 wherein the chamber comprises a front wall, an exit port for said fixative formed in said front wall, and an exit spout leading from said exit port externally from said chamber, said exit spout having outer dimensions permitting said exit spout to, in use, fit into said drill hole.

5. A device according to claim 4 wherein said fixative is contained within said chamber.

6. A device according to claim 5 wherein the fixative comprises:

a. a resin, and b. a catalyst for curing said resin, said resin and said catalyst being separated within the chamber.

7. A device according to claim 5 wherein the fixative comprises:

a. cementitious grout, and b. water, said cementitious grout and said water being separated within the chamber.

8. A device according to claim 5 wherein the fixative comprises activated or activatable cementitious grout.

9. A device according to claim 1 wherein the chamber comprises a front wall, an exit port for said fixative formed in said front wall, and an exit spout leading from said exit port externally from said chamber, said exit spout having outer dimensions permitting said exit spout to, in use, fit into said drill hole.

10. A method of installing a rock bolt and a fixative therefor in a region to be stabilized, said method comprising the steps of:

a. drilling a drill hole in a region, b. providing a device for loading a fixative in said drill hole, said device comprising a chamber holding said fixative, an exit port leading from said chamber in communication with said fixative, and a thrust member with an externally facing guide tube engageable with an end zone of a rock bolt, c. engaging said guide tube with said end zone of said rock bolt to position said exit port overlying said drill hole and maintain said chamber entirely external of said drill hole, d. applying force to said rock bolt to move said thrust member such that at least some of said fixative is displaced from said chamber through said exit port into said drill hole, and e. applying a second force to said rock bolt whereby said rock bolt passes through said thrust member into said drill hole, wherein during steps d and e, said exit port is positioned overlying said drill hole and said chamber is maintained entirely external of said drill hole.

11. A method according to claim 10 whereby said end zone of said rock bolt passes through said chamber of the device and through said exit port into said drill hole.

12. A method according to claim 10 wherein said rock bolt is rotated to mix components of said fixative.

* * * * *